US007118430B1

(12) United States Patent
Henry et al.

(10) Patent No.: US 7,118,430 B1
(45) Date of Patent: Oct. 10, 2006

(54) TERMINAL CONNECTOR WITH INTEGRAL WELDING SLEEVE

(75) Inventors: James P. Henry, Fairport, NY (US); Daniel L. Varble, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/095,307

(22) Filed: Mar. 31, 2005

(51) Int. Cl.
*H01R 9/24* (2006.01)

(52) U.S. Cl. ..... 439/884; 439/888

(58) Field of Classification Search ..... 439/874, 439/888, 884
See application file for complete search history.

(56) References Cited

U.S. PATENT DOCUMENTS 6,435,885 B1 * 8/2002 Araki et al. ..... 439/164
6,447,329 B1 * 9/2002 Yang ..... 439/492
6,482,051 B1 * 11/2002 Ide et al. ..... 439/874
6,800,001 B1 * 10/2004 Costa ..... 439/888
6,851,962 B1 * 2/2005 McCormack, III ..... 439/276
7,004,798 B1 * 2/2006 Yuasa et al. ..... 439/874

* cited by examiner

*Primary Examiner*—Khiem Nguyen
(74) *Attorney, Agent, or Firm*—Paul L. Marshall

(57) ABSTRACT

An electrical connector for use in forming a wire-wrapped welded terminal connection. The connector is formed by stamping and folding from a sheet of metal stock to include an integral sleeve element attached by a strap. During assembly of the connection prior to welding, the terminal is wrapped with wire as in the prior art and then the strap is folded to position the integral sleeve element correctly about the wrappings to form a weldable assembly functionally identical with the prior art sleeved assembly. Because the sleeve element is formed integrally with the connector and attached by a foldable strap, the element is automatically positioned correctly and is held in place by the strap during welding.

4 Claims, 6 Drawing Sheets

TERMINAL CONNECTOR WITH INTEGRAL WELDING SLEEVE

TECHNICAL FIELD

The present invention relates to connectors for electrical conductors; more particularly, to weldable wire connectors having multiple wire turns; and most particularly, to a weldable wire terminal connector having an integral welding sleeve.

BACKGROUND OF THE INVENTION

Electrical connectors attachable to ends of wires are well known. Typically in the older prior art, a terminal connector is attached to a wire as by soldering or welding at a single point. A concern with single-point soldering or welding is that electrical continuity depends upon the reliability of a single point of contact which, if weakened, can lead to higher resistance and, if broken, results in an open circuit. In the more recent prior art, a terminal may be multiply-wrapped with the wire to be attached and may be soldered, or preferably welded, to the terminal at a plurality of sites which results in a plurality of contact points and places less stress on the first wrap due to the geometry of the weld.

In the art of welding a multiply-wrapped terminal, and especially when using wire having a high-temperature rated insulative covering, it is known to provide a metal sleeve over the wire wrappings prior to welding, and to then resistance-weld the sleeve and wires together to the terminal. This method can be highly successful but requires a separate sleeve that is difficult to place and hold on the wrapped terminal during welding and typically requires the use of automated cameras to ensure that the sleeve is placed in the correct location on the terminal prior to welding.

What is needed in the art is a means for eliminating a loose sleeve from the welding process.

What is further needed in the art is a means for ensuring automatically that a weld site is configured correctly prior to welding.

It is a principal object of the present invention to provide an improved method and apparatus for forming a multiply-wrapped welded connector terminal having the same attributes as a prior art sleeved welding but without the requirement to position and hold a loose sleeve in place during the welding operation.

SUMMARY OF THE INVENTION

Briefly described, an electrical connector for use in forming a multiply-wrapped welded terminal connection is formed by stamping and folding from a sheet of metal stock to include an integral sleeve element. During assembly of the connection prior to welding, the terminal is wrapped with wire as in the prior art and then the integral sleeve element is folded about the wrappings to form a weldable assembly functionally identical with the prior art sleeved assembly. Because the sleeve element is formed integrally with the connector and attached by a foldable strap, the element is automatically positioned correctly and is held in place by the connector during welding.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
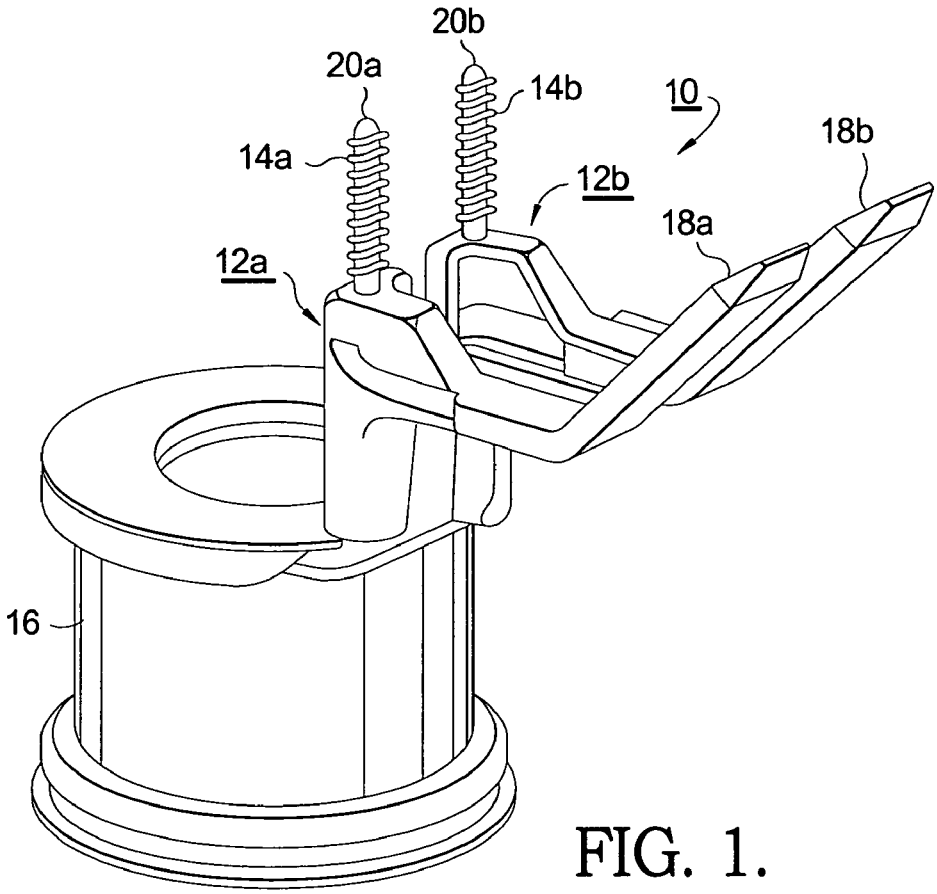
FIG. 1. (PRIOR ART)
FIG. 1 is an isometric view of a first prior art connector attached by multiple winding to a wound wire bobbin.

Referring to FIG. 1, a first prior art electrical connector assembly 10 includes left and right formed metal connectors 12*a*, 12*b* attached to positive and negative wound wire leads 14*a*, 14*b* of an electrical device 16, for example, a wound solenoid bobbin. Connectors 12*a*, 12*b* include first and second spade lugs 18*a*, 18*b*, respectively for engaging leaves of an electrical receptacle (not shown) in known fashion. Leads 14*a*, 14*b* are attached to terminal posts 20*a*, 20*b* of connectors 12*a*, 12*b* in known fashion as by soldering or welding.

Figure 1A:
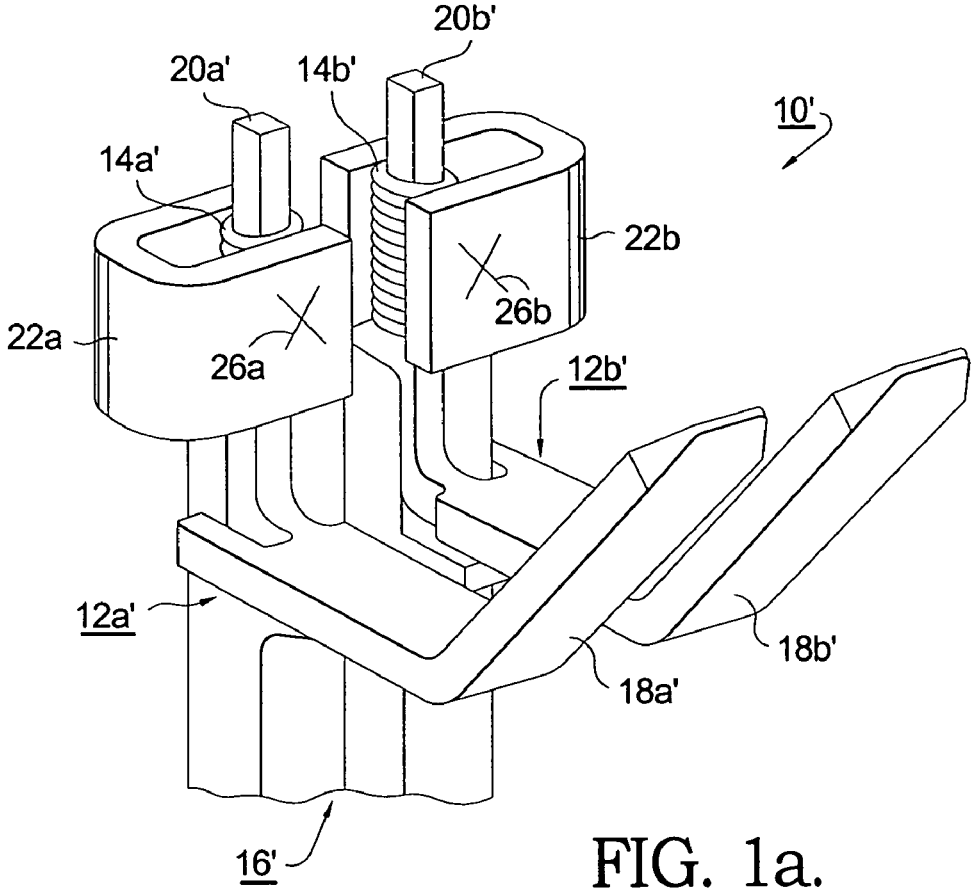
FIG. 1a. (PRIOR ART)
FIG. 1*a* is an isometric view of a second prior art connector attached by multiple winding to a portion of a wound wire bobbin, showing use of separate loose welding sleeves over the windings.

Referring to FIG. 1*a*, a second prior art electrical connector assembly 10' includes left and right formed metal connectors 12*a*', 12*b*' attached to positive and negative wound wire leads 14*a*', 14*b*' of an electrical device 16'. As in first assembly 10, connectors 12*a*', 12*b*' include first and second spade lugs 18*a*', 18*b*', respectively for engaging leaves of an electrical receptacle. Leads 14*a*', 14*b*' are attached to terminal posts 20*a*', 20*b*' by welding. Separate welding sleeves 22*a*,22*b* are then positioned over the wound wire leads and crimped to hold the sleeves in place. After verifying that the sleeves were located properly around the posts and wire leads, sleeves 22*a*,22*b* are welded in place by positioning the electrodes of a resistance-welding apparatus (not shown) at positions X 26*a*,26*b* on the front (and back, not visible) of sleeves 22*a*,22*b*.

Figure 2:
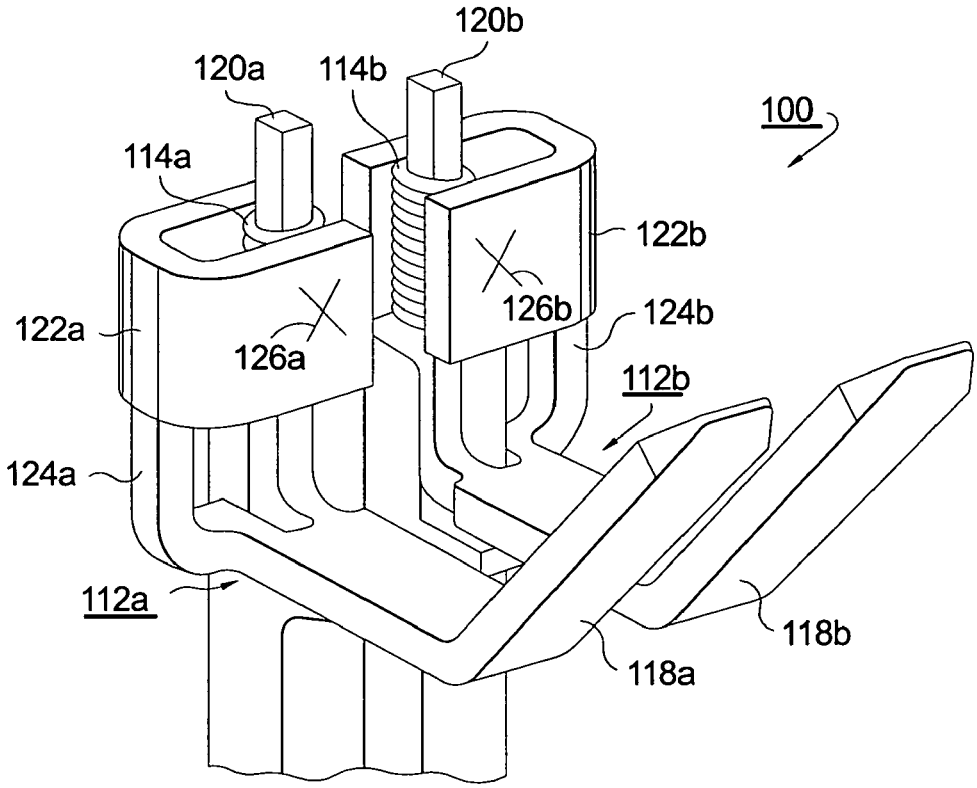
FIG. 2 is an isometric view of an improved connector (left and right), in accordance with the invention, attached by multiple winding to a portion of a wound wire bobbin, showing use of integral welding sleeves over the windings.

Referring to FIG. 2, an improved electrical connector assembly 100 in accordance with the invention includes left and right formed metal connectors 112*a*, 112*b* attached to positive and negative wound wire leads 114*a*, 114*b*. As in the prior art assemblies, connectors 112*a*, 112*b* include first and second spade lugs 118*a*, 118*b*, respectively for engaging leaves of an electrical receptacle. Leads 114*a*, 114*b* are attached to terminal posts 120*a*, 120*b* by welding. Integral welding sleeves 122*a*, 122*b* are connected to lugs 118*a*, 118*b* and terminal posts 120*a*, 120*b* by straps 124*a*, 124*b*, as further shown below in FIGS. 3–8; are pivoted into position by folding straps 124*a*, 124*b* after the wire leads are wound; and are welded in place by positioning the electrodes of a resistance-welding apparatus (not shown) at positions X 126*a*, 126*b* on the front (and back, not visible) of integral sleeves 122*a*, 122*b*. Note that the verification step to assure separate sleeves 22*a*,22*b* of the prior art are in place before welding is not necessary with the improved integral sleeves of the present invention.

An electrical connector in accordance with the invention may be formed in a large variety of shapes as may occur to one of ordinary skill in the art; however, all such connectors comprising a terminal post and an integral welding sleeve should be considered to be fully comprehended by the invention. The forming of one such connector will now be exemplarily shown.

Figure 3:
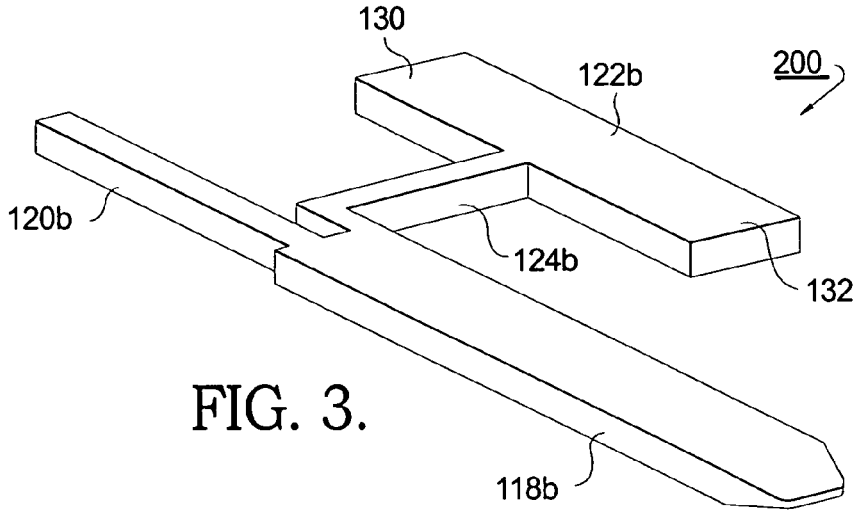
FIGS. 3 through 8 are isometric views showing successive stages in the formation of a right-handed connector in accordance with the invention.

Referring to FIG. 3, a connector blank 200 is stamped conventionally from appropriate sheet metal stock. Blank 200 includes all the elements necessary for forming, by subsequent foldings, connector 112*b* as shown in FIG. 2. Blank 200 is a "right hand" blank; obviously, an enantiomorphic of blank 200 is needed to form a mirror-image connector 112*a*. The elements delineated in flat blank 200 are spade lug 118*b*, terminal post 120*b*, integral sleeve 122*b*, and strap 124*b*.

The sequence of folding steps shown below is only exemplary and in general may be performed in any desired sequence, except for the last step, folding strap 124*b*, which is performed by the user after the windings have been placed on terminal post 120*b*.

Figure 4:
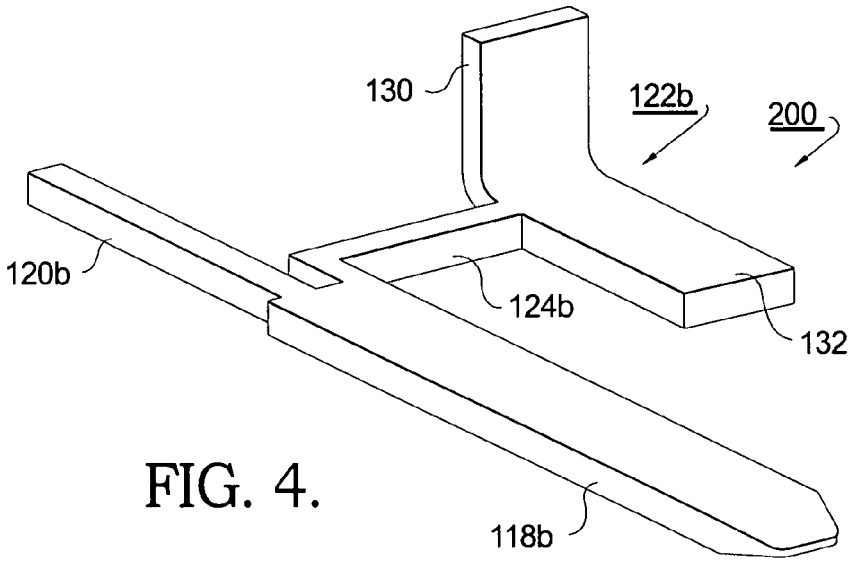
Figure 5:
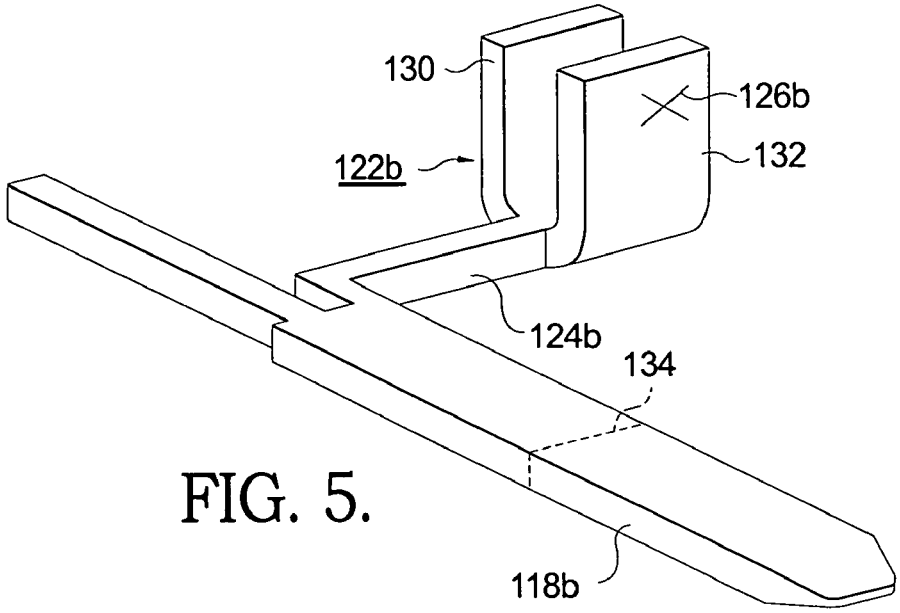

Referring to FIGS. 4 and 5, the first and second lateral extensions 130, 132 of sleeve 122*b* are folded respectively at 90° from the plane of blank 200 to form a U-shaped sleeve for later placing on the windings as shown in FIG. 2.

Figure 6:
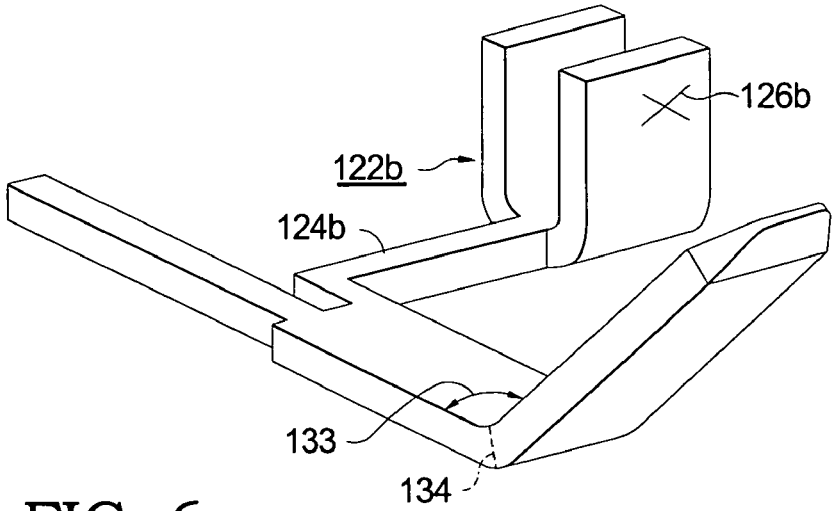

Referring to FIGS. 5 and 6, spade lug 118*b* may be optionally folded at a predetermined included angle 133, for example 135°, along a transverse line 134 to properly position the finished assembly it is respective receptacle.

Figure 7:
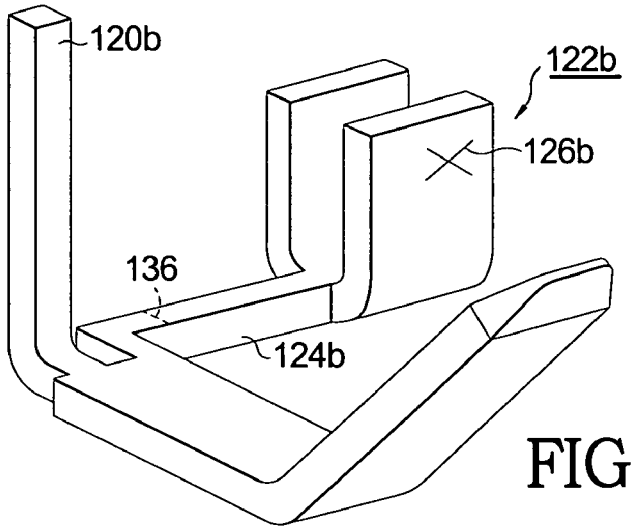
Figure 8:
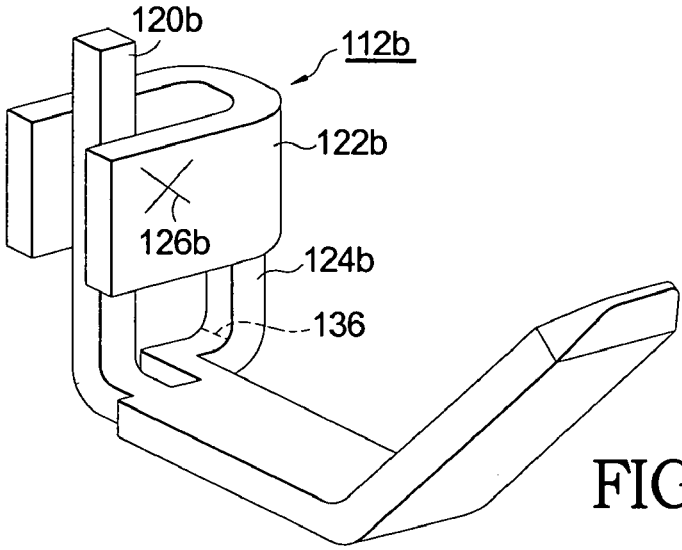

Referring to FIG. 7, terminal post 120*b* is folded 90° from the plane of blank 200 to place the terminal post in a symmetry plane of integral sleeve 122*b*, completing the manufacturing steps for connector 112*b*. As shown in FIG. 8, folding of strap 124*b* at line 136 automatically brings integral sleeve 122*b* into a surrounding relationship with terminal post 120*b*, properly positioned for resistance-welding at position X 126*b*.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An electrical connector for use in forming a terminal connection, comprising:

a) a terminal post for receiving at least one wire lead to be welded thereto;

b) a sleeve for covering said at least one wire lead and for being welded thereto; and c) a foldable strap formed integrally with said terminal post and said sleeve and extending between said terminal post and said sleeve for positioning said sleeve respective of said at least one wire lead.

2. A connector in accordance with claim 1 further comprising a spade lug formed integrally of said connector.

3. A connector in accordance with claim 1 wherein said connector is formed by stamping a blank from sheet stock and subsequent folding of said blank.

4. An electrical device comprising a wire lead attached to an electrical connector, wherein said connector includes a terminal post for receiving at least one wire of said wire lead to be welded thereto, a sleeve for covering said at least one wire for being welded thereto, and a foldable strap formed integrally with said terminal post and said sleeve and extending between said terminal post and said sleeve for positioning said sleeve respective of said at least one wire.

* * * * *